US005335530A

United States Patent [19]

Homm

[11] Patent Number: 5,335,530

[45] Date of Patent: Aug. 9, 1994

[54] PRESSING TOOL FOR PRESSING A CYLINDRICAL PRESSING MEMBER OR A PRESSING MEMBER COMPRISING A CYLINDRICAL PORTION ONTO A ROUND PROFILE, PARTICULARLY A PIPE CONDUIT

[75] Inventor: Karl G. Homm, Marl, Fed. Rep. of Germany

[73] Assignee: Hewing GmbH, Ochtrup, Fed. Rep. of Germany

[21] Appl. No.: 943,394

[22] Filed: Sep. 9, 1992

[51] Int. Cl.[5] ..... B21D 41/04

[52] U.S. Cl. ..... 72/402; 72/416; 72/452

[58] Field of Search ..... 72/402, 399, 453.16, 72/452, 407, 416; 29/237, 243, 517

[56] References Cited

U.S. PATENT DOCUMENTS

| | | | |
|---|---|---|---|
| 2,696,850 | 12/1954 | Peterson | 72/453.16 |
| 2,821,877 | 2/1958 | Swanson | 72/453.16 |
| 3,154,981 | 11/1964 | McDurmont | 72/402 |
| 3,662,450 | 5/1972 | Kish | 72/402 |
| 3,706,219 | 12/1972 | Hoffman | 72/402 |
| 3,771,343 | 11/1973 | Dawson | 29/237 |
| 4,854,031 | 8/1989 | Eisenzimmer | 29/237 |

FOREIGN PATENT DOCUMENTS

| | | | |
|---|---|---|---|
| 109536 | 7/1982 | Japan | 72/402 |
| 92016 | 5/1985 | Japan | 72/416 |
| 1306635 | 4/1987 | U.S.S.R. | 72/399 |

*Primary Examiner*—Daniel C. Crane
*Attorney, Agent, or Firm*—Diller, Ramik & Wight

[57] ABSTRACT

The pressing tool (10) comprises two holding members (26,28) adapted to be moved towards each other and having press dies (44,46) displaceably arranged thereon. Adjacent press dies (44,46) are oriented at a right angle to each other, with two press dies (44) being supported on one holding member (26) and two further press dies (46) being supported on the other holding member (28). The press dies (44,46) of both holding members (26,28) can be displaced along an axis extending at an angle of about 45° to the moving direction of at least one of the two holding members (26,28). Prior to the pressing process, the press dies (44,46) are spaced from each other, and during the pressing process, while the holding members (26,28) approach each other, the press dies (44,46) move towards each other until reaching their final closing position. Due to the displaceability of the press dies (44,46) on the holding members (26,28) and the fact that all of the press dies (44,46) are displaced by a rotational angle of about 45° with respect to the moving direction of the at least one holding member (28), the press dies (44,46) are centrically guided during the pressing process so that they move radially towards the pressing member (49) to be connected by pressing action.

7 Claims, 4 Drawing Sheets

FIG.5
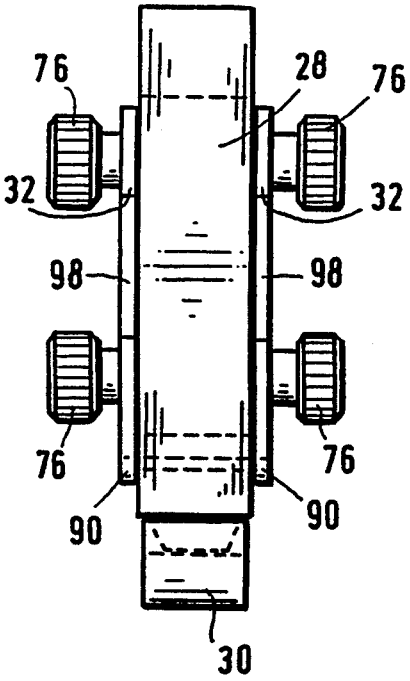
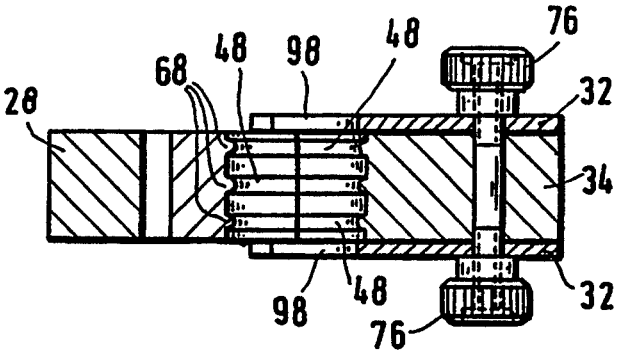
FIG.6
FIG.7
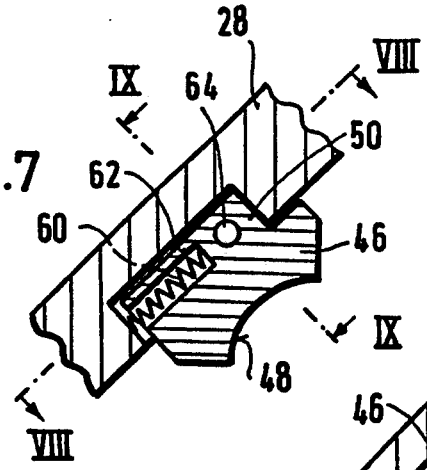
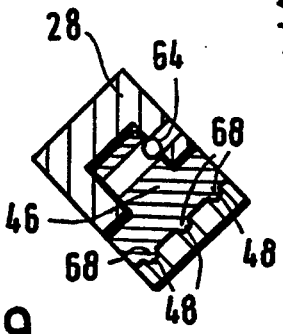
FIG.9
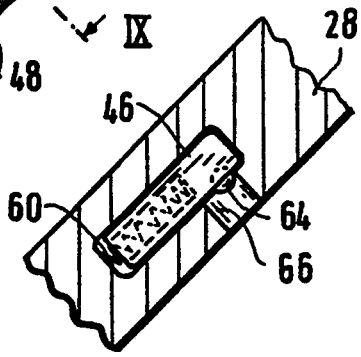
FIG.8

PRESSING TOOL FOR PRESSING A CYLINDRICAL PRESSING MEMBER OR A PRESSING MEMBER COMPRISING A CYLINDRICAL PORTION ONTO A ROUND PROFILE, PARTICULARLY A PIPE CONDUIT

BACKGROUND OF THE INVENTION

The invention is directed to a pressing tool for pressing a cylindrical pressing member or a pressing member comprising a cylindrical portion onto a round profile, particularly a pipe conduit, comprising a plurality of press dies for pressing the pressing member onto the round profile from all sides in a pressing process, and further comprising a plurality of holding members provided with receiving portions for holding the press dies, at least one of said holding members being adapted to be moved towards the other holding member(s) and away therefrom, respectively.

Pressing tools of the above type are used for establishing press connections between pipe conduits and connector pieces, so-called fittings, for connecting cable shoes or connectors to conductors (full profiles) and for similar uses. The term "round profile" as used throughout this application is meant to cover both hollow profiles and full profiles. A full profile, for instance, can also be a wire rope.

For connecting a round profile by pressing action to a connector piece of a random type, e.g. to a cable shoe, a cable connector or a pipe conduit fitting, a substantially cylindrical pressing member is pressed onto the round profile. In a connection for a pipe conduit, the pressing member can be e.g. a pressing shell enclosing the pipe conduit. In a cable connector, the cable connector itself serves as a pressing member; in a cable shoe, the cylindrical portion thereof, provided for receiving the end of the cable, constitutes the pressing member. The pressing tools utilized for effecting the press connection, being pressing pliers or pressing tools to be driven hydraulically or by a motor, comprise a plurality of press dies for pressing the pressing member onto the round profile from all sides in a pressing process. In case of a hexagonal pressing tool, for instance, two pressing dies are provided. Normally, the pressing dies are fastened on two holding members provided with receiving portions for holding the press dies. In pressing pliers, the two arms of the pliers form the holding members for holding the press dies; in a pressing tool having one holding member to be displaced in linear fashion, this holding member is provided as a longitudinally displaceable slider adapted for movement towards a usually bracket-like holding member and away therefrom.

The pliers known from DE 91 03 264.4 U1, designed for establishing pipe connections by pressing action, are provided with three press dies. Two of these press dies are supported on the arms of the pliers while the third press die is arranged in stationary manner between the arms of the pliers. The arms of the pliers are pivotable about rotational axes extending in parallel to each other, wherein, when the pressing pliers are closed, the two press dies arranged on the arms of the pliers move towards each other and in the direction of the stationary press die, while in their final pressing position they are arraged in mutual abutment and form a ring enclosing the pressing member. Since, during the closing of the pressing pliers, the movement of the press dies does not progress radially but—because of the pivoting of the arms of the pliers about the rotational axes—along an arc in the direction of the pressing member, the pressing effect is not yet optimal. Especially for the pressing of ends of pipe conduits onto fittings, high demands are posed to the tightness of the connection. These high demands regarding the tightness of the pipe connection cannot be met even by hexagonal pressing tools (no matter whether they are operated hydraulically or manually). The two press dies of a hexagonal pressing tool have different pressing faces so that the pressing has a slightly oval configuration. Also a hexagonal pressing tool suffers from the problem that those pressing faces which do not extend transversely to the moving direction of the press dies, do not move toward the pressing member in radial manner.

SUMMARY OF THE INVENTION

It is the object of the invention to provide a pressing tool, particularly for establishing a press connection between pipe conduits and fittings, which allows a press connection with a reliable sealing effect while requiring only small constructional effort.

For solving the above object, there is provided a pressing tool of the initially described type which is characterized in that each pressing die is guided in its receiving portion to be displaced in a direction extending at an angle other than 0° with respect to the direction of the force acting on the press dies during the pressing process for pressing the press dies against the pressing member, that the holding members move each of the press dies in a direction extending at an angle other than 0° with respect to the radial extension of the pressing member, and that the press dies prior to the pressing process can be moved into a starting position in which they have a defined distance from each other in circumferential direction, wherein, during the pressing process, the press dies, because of the displacement in their receiving portions and the movement of the holding members towards each other, approach each other until reaching a final pressing position.

In general terms, the press dies of the pressing tool of the invention are supported and guided on the holding members in displaceable manner so that, during the pressing, the press dies move radially towards the pressing member also if the holding members are not moved radially with respect to the pressing member but at an acute angle to the radial extension of the pressing member. Each of the holding members can have one or a plurality of press dies supported thereon. Especially when a plurality of press dies are supported on a holding member, a problem resides in that the press dies, if fastened in stationary manner on the holding member, cannot be moved radially towards the pressing member during the pressing process. The displaceable support of the press dies provided by the invention allows a centric guidance of the press dies radially towards the pressing shell.

Preferably, it is provided that each of the holding members has supported thereon two press dies arranged substantially at a right angle with respect to each other and displaced at a rotational angle of substantially 45° with respect to the moving direction of the at least one holding member, and that the press dies are guided for displacement in their receiving portions at an angle of substantially 45° with respect to the moving direction of the at least one holding member.

In this arrangement of the pressing tool, a total of four press dies are provided, which are supported on only four holding members. The holding members are e.g. the two arms of pressing pliers or the slider and the opposite fixed abutment of an e.g. hydraulically operated pressing head. The two press dies of each holding member are supported in such a manner thereon that they are displaced substantially by 90° with respect to each other while being arranged in mirror symmetry to an imaginary axis extending in moving direction, i.e. are oriented at an angle of about 45° to the moving direction. All of the press dies are guided to be displaced on the holding members; thus, the press dies can be displaced in a direction which during the pressing process forms an acute angle other than 0° with the moving direction of the press dies. For making this possible, the press dies can be moved prior to the pressing process into a starting position wherein they have a defined circumferential distance from each other. The press dies are resiliently biased into the starting position. In the subsequent pressing process, the press dies, due to the movement of the two holding members towards each other and the displacement in the receiving portions within the holding members, are moved towards each other until they maintain their final pressing position in which they preferably abut each other. In the final presing position, all of the press dies form a ring enclosing the pressing member. Due to the displaceability of the press dies within the receiving portions of the holding members, it is accomplished that the pressing faces of all press dies move radially to the pressing member although there are provided more pressing members than holding members for holding them, which perform merely a movement towards each other. Thus, movement of the pressing faces relative to the portions of the circumferential surface of the pressing member which abut on the pressing faces, is largely avoided so that a "clean" pressing with a sealing connection between the pipe conduit and the fitting is generated.

The requirements for a press connection of cable shoes and connectors with conductors are comparable to the sealing requirements of a pipe conduit connection in so far as a positive and a non-positive connection between the conductor and the cable shoe or the connector is to be generated. Also this requirement, which of course also applies to pipe conduit connections, can be fulfilled with the pressing tool of the invention so that the range of applications of the pressing tool is not restricted solely to pipe conduit connections.

In an advantageous embodiment of the invention, it is provided that the pressing faces of the press dies are arranged in such a manner that, while the press dies are in their starting positions, the pressing faces can already be brought into contact with the pressing member to be pressed. As a matter of logic, this contact cannot be performed over the complete pressing face because the radius of the convex pressing faces is smaller than the radius of the pressing member prior to pressing. Since, however, the difference between the radii is relatively small and lies preferably in the range of about 1 mm, the pressing faces are practically in abutment with the circumferential surface of the pressing member. Thus, from the beginning of the pressing process, the pressing force can be applied on all sides over the entire circumferential surface of the pressing member in the region of the press dies. This also improves the pressing effect.

Generally, the shape of the pressing faces can be selected at random. For instance, the press dies can be provided with smooth inner or pressing faces directed towards each other. Preferably, it is provided that the press dies have line-shaped concave pressing faces. Preferably, these are generated in that grooves are machined into the smooth concave pressing face of each of the press dies, resulting in linear raised portions extending in parallel to each other. Preferably, the line-shaped pressing faces or protrusions are arranged at distances from each other when the press dies are located in their final pressing position with their radial side faces abutting each other. The line-shaped pressing faces cause a constriction of the elastically deformable pressing member. For instance, the total pressing face consists of the inner faces of three rings formed by the protrusions on the mutually facing inner faces of the press dies. Undesired crushing of the material of the pressing member in the region between successive pressing faces of adjacent press dies will not occur during pressing because, due to the interior mechanical stress between the constricted portions and the bellied portions, the material in this region "flows off" towards the bellied portions.

Preferably, the line-shaped pressing faces are adjusted to the configuration of the fitting with respect to the relative position of the protrusions of the press dies. Normally, a pipe conduit fitting comprises a support body onto which the end of a pipe conduit is mounted, and a pressing shell surrounding the end of the pipe conduit. When using press dies with the above described pressing faces, the support body of the fitting is provided with peripheral beads which are axially displaced with respect to the protrusions of the pressing faces of the press dies.

Each of the holding members comprises receiving portions for the press dies. Preferably, the receiving portion for a press die is provided in such a manner that the press die on its side opposite the pressing surface comprises an adapter piece or projection which can be inserted into a receiving recess on the holding member and be displaced therein. The width and the depth of a receiving recess are substantially identical with the thickness or the projecting length of the projection of the press die; the length of a receiving recess, however, is larger than the length of the projection by the extent of the possible displacement of the press die. The press die, thus having its projection inserted into the receiving recess partially in positive connection, is reliably held therein while movement is still possible.

Preferably, the springs urging the press dies into their starting positions are respectvely arranged between the mutually facing ends of the projections of the two press dies supported on a holding member and the faces of the receiving recesses located opposite to these projection ends. The pressure springs urge the two press dies of a holding member away from each other so that these—while pressing against a pressing member without a load, i.e. without pressing force—are spaced from each other. The pressure springs are held in blind-end bores of the projections of the press dies.

Preferably, the press dies are lockingly inserted into receiving recesses of the holding members; thereby, the press dies can be easily exchanged for other press dies, with each of the press dies held in reliable manner.

With the above locking connection between the press die and the appertaining receiving portion, the locking elements are immersed in longitudinal locking depressions formed in the inner faces of the recesses. This arrangement can of course also be provided vice versa, i.e. in that the locking elements are arranged on the inner faces of the recesses and are immersed in the longitudinal locking depressions of the press dies. Thus, the locking elements also fulfill a guiding function for the displacement of the projections and thus of the press dies relative to the respective holding members within the receiving portions during displacement upon pressing and thereafter during opening of the pressing tool.

As already mentioned above, the pressing tool can be provided in the form of pressing pliers wherein the pressing dies are held on the two arms of the pliers, or the pressing tool can be a tool comprising an hydraulic, motor-driven or hand-driven pressing head having a slider guided for linear displacement therein for moving towards or away from a stationary abutment.

In this arrangement, the slider and the abutment act as the holding members for holding the press dies. The pressing head can have e.g. C-shaped configuration with or without a lockable and releasable bracket for closing the open side.

Preferably, the pressing head is arranged as a two-armed fork having its fork basis connecting the two arms. There is provided a slider acting as one of the holding members, being guided for longitudinal displacement relative to the two fork arms and carrying two press dies on its end directed to the end of the fork. The open side of the fork can be closed by a bracket to be locked releasably. The bracket acts as an abutment and is likewise provided with two press dies which are located opposite to the press dies of the slider. The bracket has both of its ends connected to the fork so that the pressing forces acting on the arm can be reliably received by the fork. Therefore, the bracket can have smaller width than the portion of a C-shaped pressing head acting as an abutment. Also in restricted space conditions, e.g. in the region of distributors of underfloor heatings, pressing can still be accomplished by the above arrangement.

Both holding members have their mutually facing sides provided with V-shaped edge recesses or v-shaped portions in whose regions the press dies are arranged. when the holding members are in abutment with each other, e.g. when the slider has been moved up to the bracket, the V-shaped edge recesses or portions, without the press dies, form a quadrangular opening which is arranged at such a rotational displacement that the diagonal line of the quadrangle coincides with the line of application of the pressing force or extends in parallel thereto. In a pressing head having a slider provided for linear displacement, the diagonal line extends in the moving direction of the slider.

Preferably, the locking point between the free end of the bracket, averted from the pivot point with the one fork arm and the other fork arm is located at a position which, when viewing the bracket from the basis of the fork, is arranged before the press dies or the pressing member. This arrangement is advantageous especially for the pressing of pipe conduits located closely side by side to each other in a row, because the distance of the individual pipe connections canlatively small, notably slightly larger than the thickness of the bracket, without hindering or preventing the use of the tool of the invention. Also the locking or release lever or the like is arranged before the press dies.

Preferably, the slider is biased in the direction of the open end of the fork so that the press dies after the locking of the bracket abut the pressing member with the force of the biasing spring. This provides for a certain fixation of the pressing tool.

Preferably, the path of displacement of the slider in the direction of the bracket is limited by guide pins entering into guide recesses of the slider. Thus, it is precluded that the slider slips out when the fork is open. The guide pins projecting from the inner side faces of the fork arm, which are immersed into the guide recesses of the slider located opposite thereto, also act as a linear guide means for the slider.

For advancing the slider with the pressing force required for the pressing, there is preferably provided a plunger extending through a passage in the fork basis and abutting the end of the slider averted from the fork opening or being connected to the slider thereat. The driving of the plunger for advancing it is performed preferably hydraulically. Suitable manual hydraulic drives are available on the market. The pressing tool of the invention can be adapted to these devices in that the fork can be screwed onto the devices or can be coupled to the hydraulic drives in some other manner (e.g. by snapping or bajonet locking).

Preferably, the slider can be completely disassembled for exchanging it in a simple and uncomplicated manner against another press die comprising differently designed receiving portions for receiving press dies having a different shape. To this purpose, the slider comprises a preferably relatively flat, solid slider core whose side edges, which are facing the inner sides of the fork arms, comprise the guide recesses for receiving the guide pins. The guide grooves extend over the whole thickness of the slider, i.e. they are provided in the manner of edge recesses limited on three sides. The receiving recesses for the projections of the press dies are shaped in the same manner. All of the edge recesses (guiding and receiving recesses) are limited by slider plates in the planes of the upper and lower sides of the slider core which enclose the slider core from above and below and are connected thereto by knurled screws or in some other manner allowing manual release of the connection. For exchange of the slider, it is merely required to release the screw connection of one of a slider plate; the slider core along with the second lsider plate can the be removed from the fork by movement transversely to the longitudinal displacement of the slider.

Preferably, the slider plates project beyond the press dies of the slider while, in this region, they are provided with a respective edge recess by which they engage around the round profile upon application of the pressing tool. This facilitates the positioning of the pressing tool. The two edge recesses of the slider plates are flush with each other and with the opening enclosed by the press dies.

The edge recesses of slider plates are particularly advantageous for a pressing action wherein the pressing tool is to be reliably secured against axial displacement relative to the round profile. The pressing member or—in pipe conduit fitting—the support body, comprises a peripheral shoulder having the edge of the edge recess of the one slider plate axially abutting thereon, while the edge of the edge recess of the other slider plate is in abutment on the axial end of the pressing member averted from the peripheral shoulder. In this manner, the fixing of the pressing tool and the pressing or the pipe conduit connector piece is obtained. Alternatively, one of the two slider plate edge recesses can be provided for setting it onto a pipe conduit fitting having a circumferential groove machined into the peripheral shoulder or for bilateral enclosure of a peripheral shoulder of a pipe conduit fitting. All of these variants are designed for providing not only a mechanical coupling of pressing toot and pressing member but, through the press dies, a positional fixing of the pressing tool relative to the round profile to be connected by press action.

An embodiment of the invention will be described hereunder in greater detail with reference to the drawings.

BRIEF DESCRIPTION OF THE DRAWINGS

FIG. 5 shows a frontal view of the pressing tool in the direction of arrow V of FIG. 4 for illustrating the lateral enclosure of the bracket by suitable edge projections of the slider plates in the locking region of the bracket and the fork;

FIG. 6 shows a sectional view along the line VI—VI of FIG. 4;

FIG. 7 shows the press die receiving region of the bracket designated by VII in FIG. 2 in horizontal section;

FIG. 8 shows a sectional view along the line VIII—VIII of FIG. 7;

FIG. 9 shows a sectional view along the line IX—IX of FIG. 7;

DESCRIPTION OF THE PREFERRED EMBODIMENTS

Figure 1:
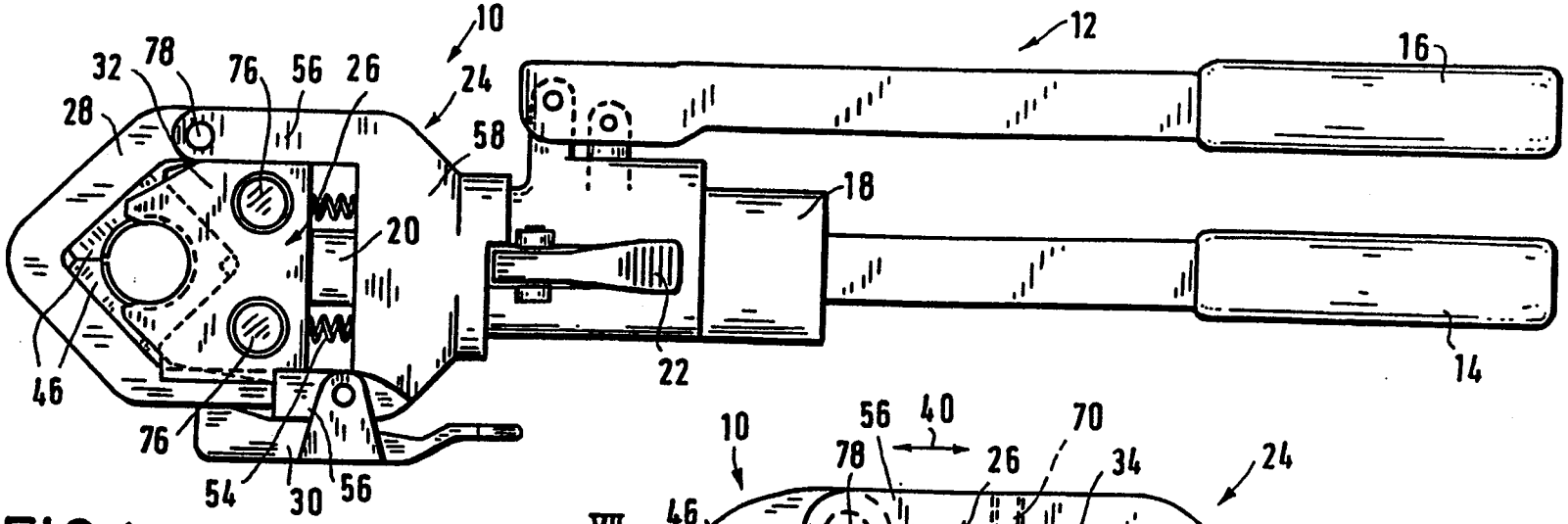
FIG. 1 shows a side view of a pressing tool screwed onto a hand-operated hydraulic device.

FIGS. 1 to 4 are side views of a pressing tool with different positions of its individual elements. As evident from FIG. 1, the pressing tool 10 is provided as a pressing head screwed onto a hand-operated hydraulic device 12. The hand-operated hydraulic device 12 is provided with a fixed and a movable handle 14,16. By upward and downward movement of the handle 16, hydraulic liquid is pumped or pressurized within a housing 18 rigidly connected to handle 14, in order to advance a plunger 20 acting on pressing tool 10. The pressing tool 10 is screwed in a known manner onto the housing 10 of the hand-operated hydraulic device 12, with a stopper arm 22 limiting a twisting movement of the pressing tool 10 relative to the hand-operated hydraulic device 12 to a rotational angle of about 180°.

The pressing tool 10 comprises a fork-shaped element 24 wherein a slider 26 is guided for longitudinal displacement. The open side of fork 24 can be closed by a bracket 28 having one end rotatably connected to one arm of the fork while its other end is adapted to be releasably locked to the other arm of the fork. The locking of bracket 28 is effected through a locking arm 30 supported on fork 24.

Figure 2:
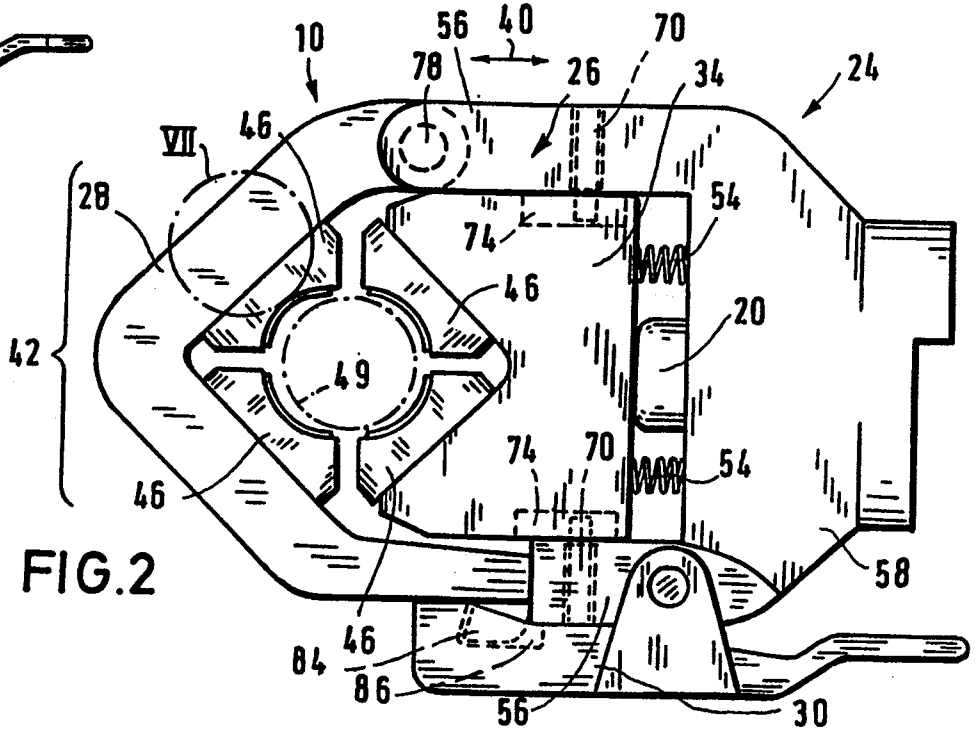
FIG. 2 shows the pressing tool according to FIG. 1 at an enlarged scale, with the press dies abutting on a pressing member without pressing force, and without a slider plate.
Figure 3:
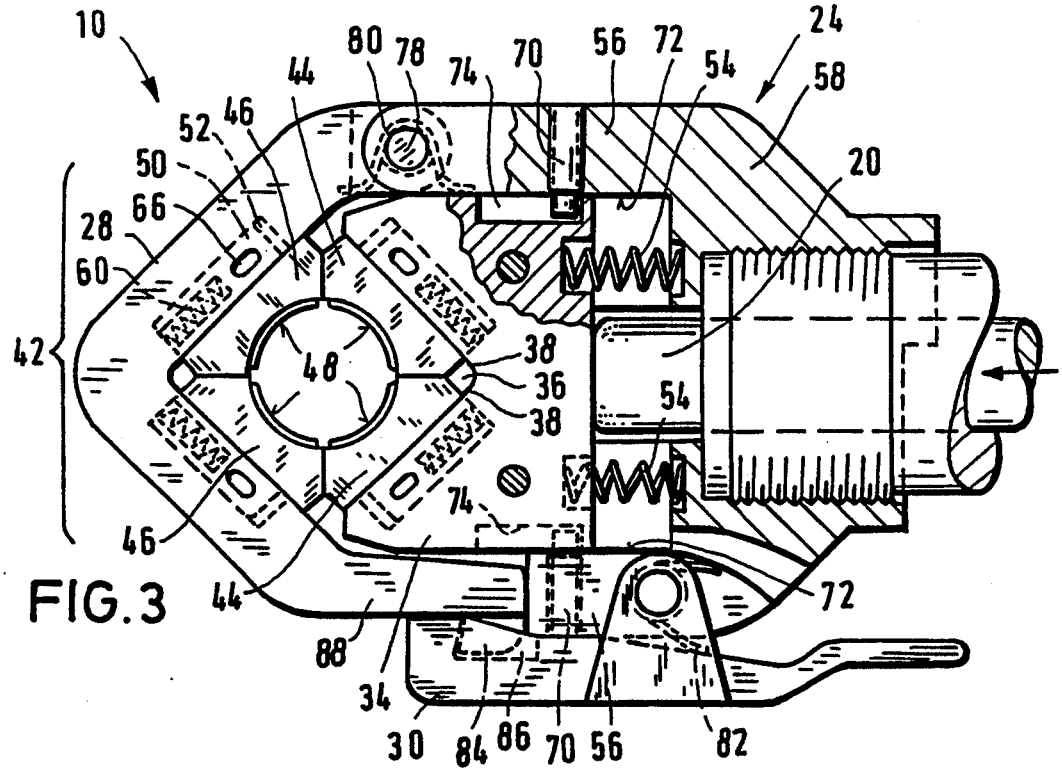
FIG. 3 shows a side view, similar to FIG. 1, of the pressing tool, partially broken away and seen in section, with the press dies being in their final pressing position, and without the pressing member.
Figure 4:
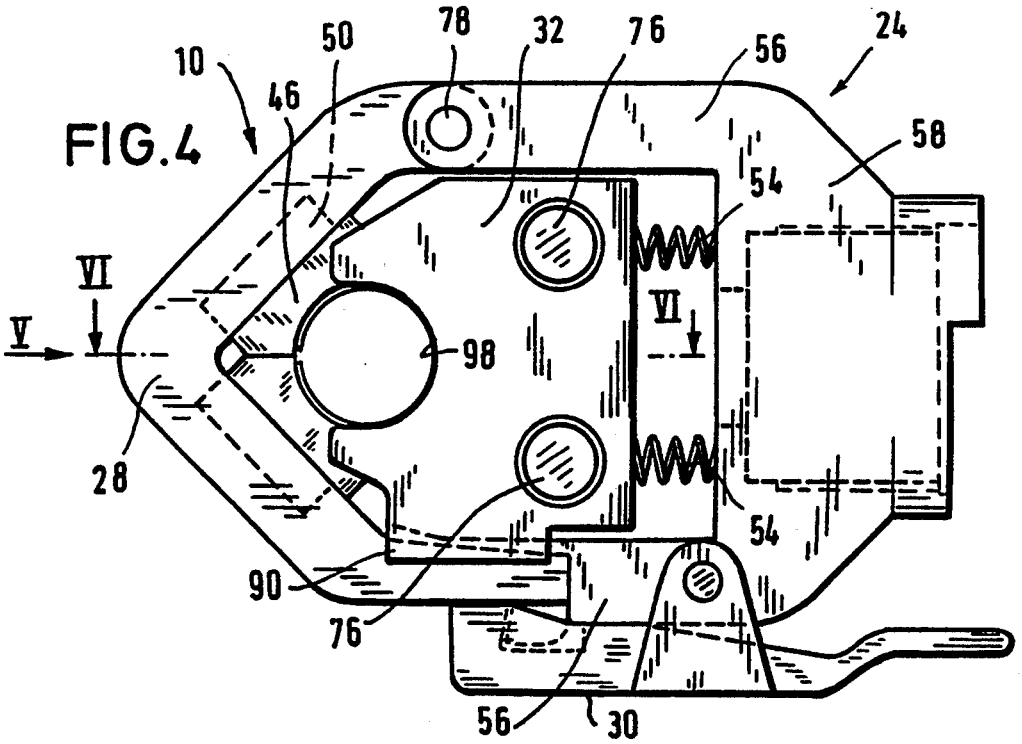
FIG. 4 shows a side view of the pressing tool with a slider plate and with the press dies in their final pressing position.
Figure 10:
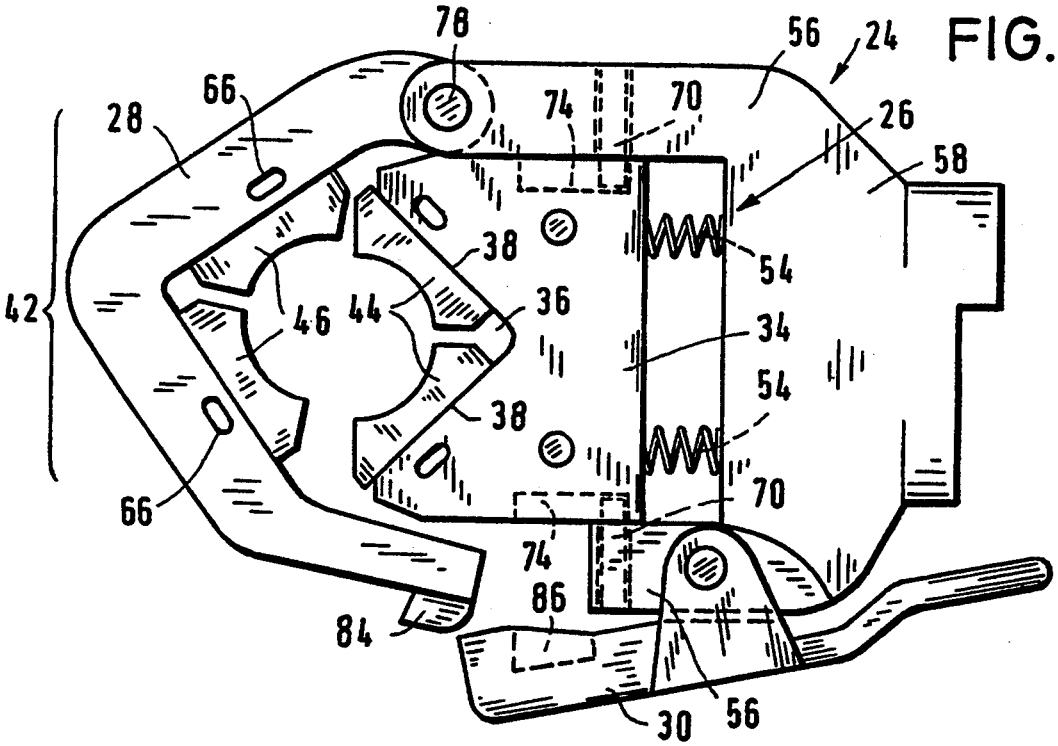
FIG. 10 shows a side view of the pressing tool with the bracket in its open position.

The slider 26 comprises two slider plates 32 (FIGS. 1 and 4 showing one of these slider plates, respectively) and a slider core 34 arranged between the two slider plates 32 (shown e.g. in FIGS. 2, 3 and 10). In the front end of slider core 34 facing towards bracket 28, there is formed a V-shaped recess 36, extending substantially over the whole width of slider core 34, with the edges 38 of its legs extending at a right angle to each other and at an angle of 45° of the direction of displacement (cf. the double arrow 40 in FIG. 2) of slider 26. In the portion opposite the V-shaped recess 36 of slider core 34, bracket 28 has a portion 42 of V-shaped configuration; the inner faces of portion 42, facing slider 26, extend perpendicularly to each other and are oriented at an angle of 45° to the direction 40 of displacement of slider 26. The four faces of the V-shaped recess 36 and of the V-shped portion 42 together form a quadrangular opening.

In the V-shaped recess 36 of slider core 34, there are arranged two press dies 44, and two further press dies 46 are arranged in the V-shaped portion 42 of bracket 28. All of the press dies 44,46 are congruent and have their mutually opposed inner faces provided with concave peripheral or pressing faces 48 extending over 90°. The exact configuration of the pressing faces 48 by which the press dies 44,46 abut on a pressing member 49 to be pressed (see FIG. 2), will be described later.

Each of the press dies 44,46 is provided, on its side opposite from the pressing face 48, with an integrally formed projection 50 which is received in a recess 52. The receiving recesses 52 are formed on the confronting faces of the the V-shaped recess 36 and the V-shaped portion 42. The receiving recess 52 is larger, i.e. longer than the width of the projection 50 so that the press die is displaceably guided on the respective face of the V-shaped recess 36 or the V-shaped portion 42. Due to this displaceability, the two press dies 44 of the V-shaped recess 36 can be moved towards each other and away from each other in the same manner as the two press dies 46 of the V-shaped portion 42. FIG. 2 shows the case in which the press dies 44 and 46 have been moved away from each other while FIG. 3 shows the case in which the press dies have been moved towards each other and brought into mutual abutment. The moving path of a press die in outward direction, i.e. from the press die arranged in the same recess or the same portion of slider core 34 or bracket 42, is limited by the abutting of the outer end face of projection 50 against the face of the appertaining receiving recess 52 opposite this end face, and the movement of the press dies towards one another is limited by the abutment of the two press dies and the abutting action of the other end face of projection 50 against the face of receiving recess 52 opposite thereto (for the last case, cf. FIG. 3).

In their starting positions, i.e. in their positions maintained before the pressing process, the two press dies 44 and the two press dies 46 are respectively spaced from one another in circumferential direction. Since the slider 26 at its rear end opposite the front end is supported through pressure springs 54 against the base portion 58 of fork 24 connecting the fork arms 56, the slider 26 is biased in the direction of the press dies 46 of bracket 28. Without the inserted pressing member 49, the press dies 44 and 46 following each other in circumferential direction, would laterally abut each other; with the pressing member 49 inserted, however, the distance between the press dies 44 and 46 is substantially equal to the mutual distance of the press die 44 or 46 from each other. This is also the result of the configuration of the pressing faces 48 of press dies 44,46. Also when the pressing member has not been pressed yet, these pressing faces 48 lie against the circumference thereof, notably to the largest possible extent in face-to-face abutment, which, however, cannot be fully realized due to the different radii of curvature of the pressing face and the circumferential surface of the pressing member.

With reference to FIGS. 6 to 9, a more detailed description will be given hereunder of the manner in which the press dies 44,46 are received in the receiving recesses 52 and of the arrangement of the pressing faces 48. This description will be rendered by way of example with reference to press die 44 which is arranged in the upper half of the V-shaped portion 42 of bracket 28 with respect to the side views of the tool 10 according to FIGS. 1 to 4 and 10. Each of the press dies 44 is biased into its starting position by means of a helical pressure spring 60. The pressure spring 60 is received in a blind-end bore 62 formed in the one end side of the press die projection 50 and extending in the direction of the displacement of the press die. The pressure spring 60 projects beyond the inner end face of the projection, i.e the face directed to the gorge of the V-shaped recess or the V-shaped portion and is supported on the face of the receiving recess 52 opposite thereto (see FIG. 7). Further, the projection 50 is provided with a spring-based locking ball 64 which is immersed in a locking recess 66 being in turn formed in the face of the receiving recess opposite the locking ball 64. The locking recess 66 is formed in such a manner that the locking ball 64 will move therein when the press die 44 is being displaced. Thus, the locking ball and the locking recess also act as a guidance for guiding the press die 44 in the receiving recess 52.

As is shown particularly in FIGS. 6 and 9, the pressing face 48 of a press die consists of three linear faces extending in parallel to each other, being arranged at distances from each other and being formed by the surface of rib-like raised portions 68. The ends of the rib-like raised portions 68 of two adjacent press dies are distanced from each other although these abut each other. The distance is relatively small and amounts to a few millimeters only.

As can be seen especially in FIG. 3, the slider 26 is guided on guide pins 70 inserted in through-holes of the fork arms 56 and projecting beyond the mutually facing inner faces 72 of the fork arms 56. The projecting portions of these confronting guide pins 70 are immersed in lateral guide reccesses 74 machined into the lateral edges of slider core 34. The guide pins 70 limit the advance movement of slider 26 by abutment on the end face of guide recess 74 arranged to the rear when viewed in advance direction (see particularly FIG. 3).

The receiving recesses 52 and the guide recesses 74 of slider 26 can be formed in slider core 34 as in the embodiment shown in the Figures. Alternatively, it can be provided that these recesses are not only formed or defined by the slider core but also by slider plates 32 connected to the slider core by knurled screws 76. This would particularly offer the advantage of a simpler manufacture of the locking recesses 66 in the press die receiving recesses 52. On the other hand, there exist diverse manufacturing techniques (e.g. material processing by spark or arc erosion) which allow the formation of the locking recesses 66 in the side faces of the receiving recesses 52.

As is evident from the Figures, the two fork arms 56 have different lengths. On the end of the longer of the two fork arms 56, the one end of bracket 28 is pivotably supported; bracket 28 is biased in the opening direction by a leg spring 80 enclosing the pivot axis 78 between fork 24 and bracket 28. By means of another leg spring 82, the locking arm 30 is biased against the free end of bracket 28 or in lateral direction towards slider 26. The free end of bracket 28 is provided with a locking projection 84 immersed into a locking recess 86 of locking arm 30 when bracket 28 is locked. The locking arm 30 is supported on the shorter one of the two fork arms 56 so that the bracket 28 in the region of its free end provided with the locking projection 84, is arranged substantially in parallel to the longer one of the two fork arms and constitutes, as it were, an extension of the shorter fork arm 56. In this end portion 88, the bracket 28 extends laterally to slider 26. For preventing undesired twisting of bracket 28, bracket 28 has its end portion 88 partially enclosed between slider plates 32 which are provided with two lateral projections 90 to this purpose (see FIG. 4).

By the shortening of the fork arm 56 provided with the locking bracket, the locking point between the bracket and the fork arm is displaced towards the fork basis 58. This offers the advantage that the locking—as seen from the viewpoint the assembly worker handling the pressing tool—takes place before the pipe conduit connection. In addition to the simplified handling, this solution also complies with narrow space conditions, notably if—as is usual with an underfloor heating—the pipes or pipe conduits to be connected are arranged side by side next to each other and at a small distance to the wall arranged therebehind. The narrow bracket 28 together with the displacement of the locking or release mechanism to the assembly worker makes it possible to use the pressing tool shown in the Figures also in a restricted space.

The operation and the application of the pressing tool 10 will be described in short hereunder. For insertion of the pressing member indicated by 49 in FIG. 2 into the mouth of pressing tool 10 formed by the four press dies 44,46, the bracket 28 of pressing tool 10 is opened by actuating the locking arm 30 and is pivoted to the side. Then, the bracket 28 is moved into the closed position. During the closing movement, the press dies 46 of bracket 28 will press—through pressing member 49—against the press dies 44 of slider 26 which thereupon will move back by a certain distance against the force of the pressure springs 54. The reason for this process is that the press dies 44,46 in their starting position shown in FIG. 2 have a circumferential distance from each other, with their pressing faces 48 already abutting the circumferential surface of the pressing member 49. The distance between the press dies 44,46 and among themselves is shown in relatively large dimensions in FIG. 2; actually, it can be selected to be much smaller, which will depend also on the type of pressing (hollow or round profile, cable shoe or connector pressing or pipe conduit pressing).

After the bracket 28 has been moved into the closing position, the hand-operated hydraulic device 12 is actuated for moving the plunger 20 against the rear end of slider 26 so that slider 26 will be moved in forward direction upon further operation of the hand-operated hydraulic device 12. Through the pressing faces 48, the pressing member 49 is subjected to a pressing force for effecting the pressing. During the advance movememt of slider 26 in the actual pressing process, the press dies 44,46 are displaced along the respective abutment faces of the V-shaped recess 36 in slider 26 and of the V-shaped portion 42 of bracket 28. By the displaceable accommodation of the press dies 44 and the press dies 46, these will move towards one another; the advance movement of slider 26 in the direction of the stationary bracket 28 reduces the distance of two circumferentially successive press dies 44,46. In this manner, the linear movement of slider 26 is transformed into a radial movement of press dies 44,46 which, because the pressing faces 48 are arranged as surfaces of the raised portions 68 forming a circle, leads to concentric constrictions of the pressing member 49. A pipe connection which can be formed through pressing action by use of the pressing tool provided with such pressing faces, is described in the German Utility Model specification DE 90 60 310.9 U1 of the applicant. The disclosure of this German Utility Model specification is herewith incorporated by reference into the disclosure of the instant invention.

In connection with the different embodiments of a pipe conduit fitting shown in FIGS. 11 and 12, there will be described now the manner in which the pressing tool 10 during the pressing process is fixed on the fitting while being secured against axial displacement. The pipe conduit connectors of FIGS. 11 and 12 to be used for interconnected pipes comprise a clutch-like support body 92 which in its middle is provided with a circumferential collar or circumferential shoulder 94. Onto the support bodies 92, the ends of two pipes 96 are mounted on both sides. Around the pipe ends, there are arranged elastically deformable pressing members 49 formed as pressing shells. The pressing shells, being deformed during the pressing process, become anchored to the material of the pipes whose material in turn penetrates into circumferential recesses of support body 92, thus safeguarding a positive and a non-positive connection between the pipe and the connector.

Figure 11:
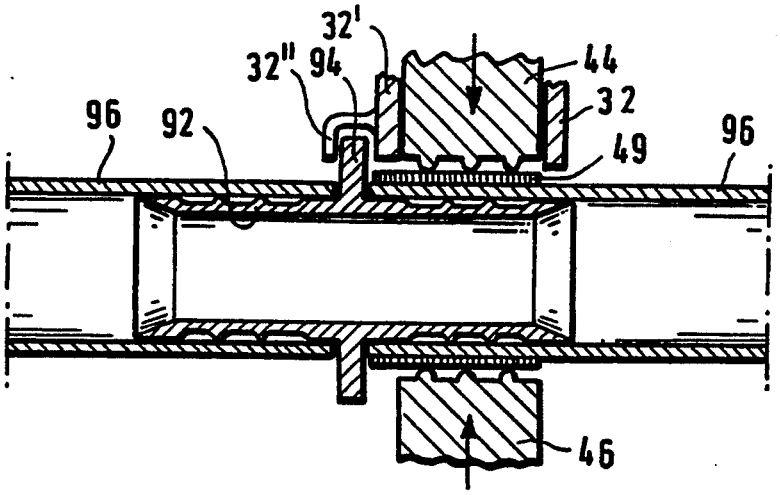
FIGS. 11 and 12 show longitidinal sectional views of a first and a second pipe conduit fitting, with the press dies abutting on the pressing member without pressing force.
Figure 12:
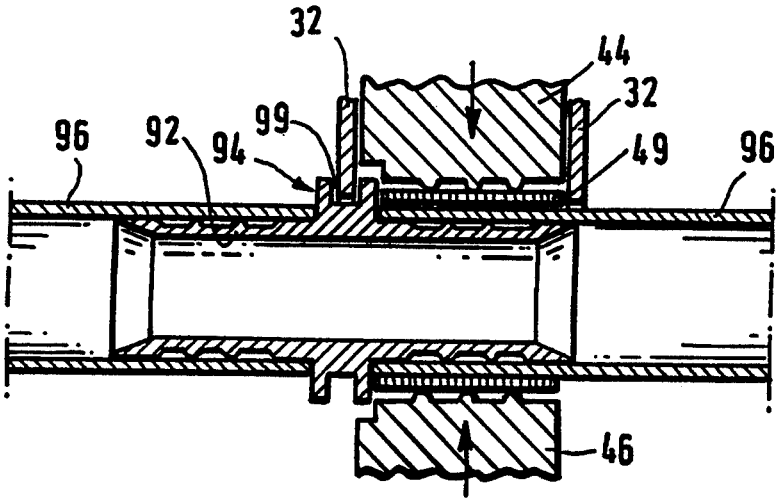

The sectional views shown in FIGS. 11 and 12 substantially correspond to the sectional view shown in FIG. 6 except for the difference that also the pipe is shown together with the fitting to be pressed.

For axially fixing the presing tool 10 to the fitting or pipe connection piece, the ends of the slider plates facing towards bracket 28 have edge recesses 28 formed therein which surround the pipe, the pressing shell and the circumferential shoulder. The recesses 98 of the two slider plates 32 are flush with each other and with the opening limited by the pressing faces 48 of the press dies 44,46. The slider plates 32 are extended beyond the two slider press dies 44 and thus enclose these press dies 44 to both sides. According to FIG. 11, the edge of the slider plate recess 98 is immersed into a circumferential groove 99 formed in the circumferential shoulder 94. Thereby, the whole tool is secured against axial displacement. In this position of the pressing tool 10 and the fitting relative to each other, the second slider plate 32, on the frontal end of the pressing shell facing away from the circumferential shoulder 94, abuts the annular surface of this end, with the appertaining edge recess 98 otherwise surrounding the pipe 96.

For pressing the fitting onto a support body 92 according to FIG. 12, in a case when the circumferential shoulder is not provided with a circumferential groove, there is used a slider plate 32' which is formed like a fork at its end facing toward bracket 28. The C-shaped edge 32'' of slider plate 32 delimiting the recess 98 grips around the circumferential shoulder 94 from both sides; the other slider plate 32 can abut the frontal end of the pressing shell facing away from circumferential shoulder 94, as has been the case with the fitting of FIG. 11.

I claim:

1. A pressing tool for pressing a cylindrical pressing member onto a round pipe conduit, comprising a plurality of press dies (44, 46) for pressing a cylindrical pressing member (49) onto a round pipe conduit (96) from all sides, a plurality of holding members (26, 28) provided with receiving portions for holding the press dies (44, 46), means for creating a pressing force by moving at least one of said holding members (26, 28) or away from another of said holding members (26, 28) linearly in a radial direction relative to the cylindrical pressing member (49), means for guiding each pressing die (44, 46) in its associated receiving portion for displacement in a direction extending at an angle other than 0° with respect to said radial direction of the pressing force, the holding members (26, 28) move each of the press dies (44, 46) in a direction extending at an angle other than 0° with respect to the radial direction of the cylindrical pressing member (49), the press dies (44, 46) prior to the pressing process can be moved into a starting position in which they are in abutment against the cylindrical pressing member (49) and have a defined distance from each other in a circumferential direction, the press dies (44, 46), because of displacement in their receiving portions and the movement of the holding members (26, 28) towards each other, approach each other until reaching a final pressing position, each of said press dies (44, 46) include a lateral face extending in the direction of displacement of said press dies, a spring-based projecting locking element (64) projecting from each lateral face, a receiving recess (52) formed in said holding members (26, 28) receiving therein an associated one of said pressing dies (44, 46), and a longitudinal locking recess (66) formed in a lateral face of each receiving recess (52) opposite an associated locking element (64) into which the locking element (64) is moved during displacement of the press dies (44, 46).

2. The pressing tool as defined in claim 1 wherein said press dies (44, 46) abut each other in their end positions and form a closed ring surrounding the cylindrical pressing member.

3. The pressing tool as defined in claim 1 wherein said press dies (44, 46) are provided with pressing faces (48) abutting the cylindrical pressing member (49) during the pressing process, and said pressing faces (48) are constructed and arranged to be brought into contact with the cylindrical pressing member (49) when the press dies (44, 46) are in their starting positions.

4. The pressing tool as defined in claim 1 wherein said press dies (44, 46) comprise linear concaved pressing faces (48).

5. The pressing tool as defined in claim 1 wherein said press dies (44, 46) include confronting concave pressing faces (48) which are provided with a plurality of parallel linearly raised portions (68).

6. The pressing tool as defined in claim 1 wherein one holding member (26) is a slider guided for displacement in a two-armed fork element (24) which opens in a direction toward said another holding member (28), said another holding member (28) is formed as a bracket articulated to one arm (54) of said two-armed fork element (24), and said bracket is adapted to be releasably locked to the two-armed fork element (24) for closing an open side thereof in a closing position.

7. The pressing tool as defined in claim 1 wherein both holding members (26, 28) each include one of a V-shaped edged recess (36) and a V-shaped portion (42) with side faces (38) thereof arranged at a right angle to each other.

* * * * *